US005601055A

United States Patent [19]

Haines

[11] Patent Number: 5,601,055

[45] Date of Patent: Feb. 11, 1997

[54] ROTARY VEE ENGINE WITH SUPPLY PISTON INDUCTION

[76] Inventor: Robert M. Haines, 10182 Josephine, Thornton, Colo. 80229

[21] Appl. No.: 333,256

[22] Filed: Nov. 2, 1994

[51] Int. Cl.[6] ..... F02B 57/06

[52] U.S. Cl. ..... 123/43 A; 123/70.1

[58] Field of Search ..... 123/43 A, 43 AA, 123/56.1–56.4, 56.7, 70 V

[56] References Cited

U.S. PATENT DOCUMENTS

| | | | |
|---|---|---|---|
| 2,026,705 | 1/1936 | Pratt | 123/43 A |
| 2,512,265 | 6/1950 | Brigaudet | 123/43 A |
| 2,551,478 | 5/1951 | Wagers | 123/70 V |
| 3,902,468 | 9/1975 | Turner | 123/43 A |
| 3,905,338 | 9/1975 | Turner | 123/43 A |
| 3,973,526 | 8/1976 | Kokochak . | |
| 3,973,527 | 8/1976 | Nilsson et al. . | |
| 3,973,531 | 8/1976 | Turner | 123/43 A |
| 4,060,060 | 11/1977 | Turner | 123/43 A |
| 4,648,358 | 3/1987 | Sullivan et al. | 123/43 A |
| 4,867,107 | 9/1989 | Sullivan et al. . | |
| 5,159,902 | 11/1992 | Grimm | 123/43 A |

FOREIGN PATENT DOCUMENTS

| | | | |
|---|---|---|---|
| 866567 | 6/1953 | Germany | 123/43 A |
| 557736 | 11/1943 | United Kingdom | 123/43 A |
| 580194 | 8/1946 | United Kingdom | 123/43 A |

OTHER PUBLICATIONS

E. F. Lindsley, "Say, Smokey . . . A Steam Engine?", Popular Science, Dec. 1971, pp. 48–49.

E. F. Lindsley, "Unbelievable–But We've Seen it All Work", Popular Science, Aug. 1974, pp. 62–117.

David Scott, "Rotary V Engine", Popular Science, Feb. 1976, pp. 106–107.

Bob Tripolsky, "Bricklin Comes Back With a Rotary Engine", Mechanix Illustrated, Jan. 1977, pp. 50–52.

Dick Cavin, "Rotary Vee Engine", Sport Aviation, Feb. 1986, pp. 16–18.

*Primary Examiner*—Michael Koczo

*Attorney, Agent, or Firm*—James R. Young

[57] ABSTRACT

A rotary internal combustion engine having a plurality of pairs of angled pistons, each pair having a power piston and a corresponding supply piston. As the power piston of a pair fires to provide rotation for the engine, the corresponding supply piston draws a fresh fuel air charge from the center section of the engine. As the supply piston compresses the fuel air mixture, the mixture is delivered at the top of the power cylinder for the next firing. The exhaust port is located at the bottom of the power piston stroke and the fuel intake is at the top of the cylinder, to increase the efficiency of the engine. Roller bearings are mounted between each cylinder block and an engine outer casing to support the engine.

7 Claims, 6 Drawing Sheets

ROTARY VEE ENGINE WITH SUPPLY PISTON INDUCTION

BACKGROUND OF THE INVENTION

1. Field of the Invention

The present invention relates to improvements in internal combustion engines and, more particularly, to improvements to internal combustion engines of the rotary vee type. Even more particularly, the invention relates to providing a fuel air charge to a power piston by using a supply piston; and an improved bearing for supporting the cylinder block.

2. Description of the Prior Art

Historically, internal combustion engines have been of the four stroke reciprocating designs, wherein a piston or pistons within a stationary block reciprocate (travel back and forth) to provide intake, compression, expansion, and exhaust. The pistons are connected to a crankshaft with piston rods, and the crankshaft delivers the power from the engine. During the intake stroke a valve(s) allows a fresh fuel air charge into the cylinder. During the exhaust stroke another valve(s) opens to allow the burnt fuel air mix to be expelled. These valves are operated by one or more camshafts driven by the crankshaft, however, the means to operate the camshafts that drive the valves can be complex and can increase friction within the engine.

Another type of reciprocating engine is the two-stroke engine. The operating cycle of a two-stroke engine includes a compression stroke and an expansion or power stroke. Exhaust and intake functions occur respectively as the piston approaches and moves away from the bottom dead center position, when the piston uncovers the intake and exhaust ports. Intake occurs in overlapping relation to exhaust, creating incomplete scavenging of the exhaust gases within the cylinder. Because the intake and exhaust ports are in close proximity to each other, and open simultaneously, a portion of the fresh fuel air charge can be lost to the exhaust when both the intake and exhaust ports are opened by the piston, decreasing the efficiency of the engine.

While either the four or two stroke reciprocating engine provides the majority of power for modern cars, light planes, boats, busses, trucks, etc., the reciprocating engine has an inherent problem that vitally effects it's efficiency. In particular, the reciprocation of the piston involves a sequence of acceleration of each piston from rest, followed by a deceleration of each piston to rest. The work done on the pistons during this acceleration and deceleration is not recovered, so the energy necessary to do this work causes a general loss of efficiency of the engine.

A class of engines called the rotary vee holds promise for overcoming the losses due to the reciprocating motion of the conventional internal combustion engine. The rotary vee engine includes two cylinder blocks that are cylindrical in shape and mounted within a housing to allow each cylinder block to rotate. The cylinder blocks contain a plurality of parallel bores, open at one end, to allow insertion of a portion of a double ended piston. The cylinder blocks are angled, relative to each other, between 90 and 180 degrees. The pistons are also angled at the same degree as the cylinder blocks, so as the cylinder blocks rotate within the housing, the pistons rotate with them. As the pistons move from the inside portion of the "V" to the outside portion, the free volumes of the cylinders change, causing compression and expansion.

While the rotary vee holds promise of very smooth and fuel efficient operation, some problems with the prior an engines have kept it from becoming a commercial success. These problems include a fuel air intake system that must operate effectively in the high centrifugal force field of the rotary vee; a cylinder block support system to maintain the vee configuration of the engine while in operation; a cooling airflow system that provides increased engine cooling during high load, low R.P.M. operation; and the ability to control the spark timing for easier starting and better high R.P.M. operation.

In the prior art, the intake and exhaust of a fuel air admix is accomplished as in a two-stroke engine. When the piston approaches bottom dead center, the exhaust port is uncovered first, and then the piston uncovers the intake port. In the high centrifugal force field of the rotating cylinder block of the rotary vee, the fresh fuel air admixture surges through both the intake and exhaust ports when they are uncovered, leaving little or nothing to burn in the next stroke.

One attempt to overcome this problem is disclosed in U.S. Pat. No. 3,905,338 issued Sep. 16, 1975 to William F. Turner, entitled "Vee Engine with Centrifugally Assisted Scavenging." This patent shows intake and exhaust ports machined into the plates that are stacked to form a cylinder block. The design of the ports provides a fresh fuel air admixture in from the radial exterior side of the cylinder, and ports the exhaust inward to the center of the cylinder block and, after the exhaust changes direction 180 degrees, the exhaust is expelled to the outside. The principle is to use centrifugal force to help with the intake and exhaust. Centrifugal force has a greater effect on the heavier cooler fuel air admixture that comes into the cylinder forcing the hot, light exhaust gases to the inside of the cylinder block.

U.S. Pat. No. 4,867,107, issued Sep. 19, 1989 to Robert W. Sullivan, et al. addresses the intake/exhaust porting in essentially the same way as the Turner engine. That is, intake of a fuel air charge occurs from the radial exterior side of the cylinder and the exhaust of the fuel air mix occurs inward to the center of the cylinder block. After changing direction 180 degrees, the exhaust is expelled to the outside. However, unlike the Turner engine where machined plates are stacked to form the cylinder blocks, Sullivan uses an aluminum casting process. Whether the cylinder blocks are cast or machined, the passages that form the intake and exhaust ports adds complexity, and consequently cost, to the cylinder blocks. Another characteristic of the Sullivan engine involves the shape of the outer ends of the pistons, which are machined to provide valving action through the use of the pistons' cyclical and linear motion relative to the cylinder wall, and thus relative to the intake and exhaust ports. The shape of the piston may help with the valving action, however, this shape is not optimum for taking advantage of an expanding gas within a cylinder. To extract the most energy from a fuel air mix, the shape of the piston should be flat or slightly hemispherical.

In the above cited prior art, the classic two stroke problem still remains. That is, the intake and exhaust ports are in close proximity to each other, and open simultaneously, when the piston is at bottom dead center. Thus, the fresh fuel air charge surges through, incompletely scavenging the cylinder and sending a portion of fresh fuel air admixture into the exhaust stream.

Another attempt to overcome the intake/exhaust problems inherent in the rotary vee is shown in U.S. Pat. No. 5,159,902 issued Nov. 3, 1992 to Louis C. Grimm, entitled "Rotary Vee Engine with Through-Piston Induction." This patent proposes the use of hollow pistons and numerous cylinder sleeves. Each sleeve is machined with elongated grooves that align at different degrees of rotation to allow for the intake and exhaust of a fuel air admixture. The sleeves that make up the cylinder walls slide within each other, so the ability to lubricate and keep the sleeves cool while working in the heat and pressure of a cylinder adds an element of complexity and is not a well-proven principle in engine manufacture.

As delineated in Sullivan, described above, because of the angled disposition of the rotating cylinder blocks, combined with the firing of each cylinder at one side of the cylinder block, forces caused by the firing tend to spread the two cylinder blocks into a straight line, that is, out of the vee configuration. Such forces result in drag between the pistons and cylinder blocks that interfere with the operation and efficiency of the engine. Because of this problem, rotary vee engines have not enjoyed much success, despite the promise they hold and, indeed, it has been found that an engine constructed in the rotary vee configuration will often not even operate because of these problems.

Sullivan further describes a solution by which an angled support shaft, running lengthwise through the center of the cylinder blocks and having portions that extend from the ends of the cylinder blocks, is supported by the outer housing in which the cylinder blocks are disposed. While the support shaft can be supported at each end of the housing, support at the apex of the vee is impossible due to the rotation of the cylinder blocks and the pistons.

Sullivan and Turner, described above, show an engine air cooling design, by which the cooling air is drawn in from each end of the cylinder block, over the cylinders for cooling and expelled out the outer housing. Cooling airflow in this configuration is restricted by the fact that the air must flow between the outer housing and the center support shaft. In this configuration, airflow available during high output low RPM operation would appear to be inadequate.

These patents also show that the ignition of the fuel air admixture takes place when a spark plug, while rotating within its respective cylinder block assembly, comes into conduction with a fixed contact. Thus, it is not possible to retard the spark timing for easier starting, or advance the spark timing for fuel efficient high speed, high load operation.

SUMMARY OF THE INVENTION

Whatever the precise merits, features and advantages of the above cited references, none of them achieve or fulfill the purposes of the present invention, the Rotary Vee Engine with Supply Piston Induction.

Accordingly, an aspect of the present invention is to achieve greater exhaust scavenging and recharging of a fuel air admixture within a rotary vee engine. This is accomplished with a hollow supply piston at 180 degrees rotation relative to a power piston. This supply piston delivers a precise, measured amount of a fuel air admixture charge to the top of the power piston cylinder, while the exhaust of the burnt fuel air admixture is being expelled through an exhaust port uncovered by the power piston, when it nears its bottom dead center position. This supply piston does not burn a fuel air admixture, instead its sole purpose is to supply the power piston with a precise, measured amount of a fresh fuel air admixture. The intake of the fuel air admixture at the top of the power piston cylinder, and the exhaust of the burnt admixture at the bottom of the power piston cylinder, provides greater scavenging of exhaust gases through separation of the intake and exhaust ports. This separation further increases the efficiency of the rotary vee engine, and also allows shaping of the power piston ends to take full advantage of an expanding gas within a cylinder.

Another aspect of the present invention is to provide a cylinder block support system comprising tapered roller bearings externally mounted at fore and aft end of the cylinder blocks, to provide greater rigid support while the cylinder blocks rotate. The location of the cylinder block bearings allows elimination of the center support shaft assembly of the prior art and the complexity associated therewith.

Another aspect of the present invention is to provide cooling fins of an airfoil shape as an integral part of the cylinder blocks, wherein the cooling fins provide for greatly increased cooling airflow. Air intake slots are integrated into the outer housing. The cooling airflow, after being drawn past the cylinders and removing the combustion heat, is then expelled through the center and top of the cylinder blocks. With the elimination of the center support shaft, the present invention has fewer obstructions as it draws the cooling airflow past the cylinders.

A further aspect of the present invention is to control the spark advance. The spark plugs are connected through a slip ring, and each plug is fired at the proper time by a computer controlled ignition source. Computer controlled spark timing allows for retarding of the spark for easier starting while advancing of the spark for better high R.P.M. high load conditions. Control of spark timing greatly increases the performance and efficiency of the rotary vee engine of the present invention.

In fulfillment and achievement of the previously recited aspects, a primary feature of the invention is to provide a unique fuel air intake system. As the rotary vee rotates, the free volume of the cylinders changes. As a first piston moves upward, a second piston, located at 180 degrees rotation relative to the position of the first piston, moves downward. That is, as a first piston travels upward, a second piston that resides in a cylinder directly across from the first piston travels downward. This difference in piston travel allows the present invention to use one piston to provide power for the engine through the burning of a fuel air admixture, while a supply piston, opposite of the power piston, is used to draw in and deliver fresh fuel air admixture to the power piston. The supply piston draws the fresh fuel air admixture from the apex of the engine, and the power piston and the supply piston are interconnected so the fuel air admixture can be delivered from the supply piston to the power piston.

Other aspects, features and advantages of the engine of the present invention will become clear from the following detailed description of the engine when read together with the drawings and appended claims.

DETAILED DESCRIPTION OF THE DRAWINGS

Figure 1:
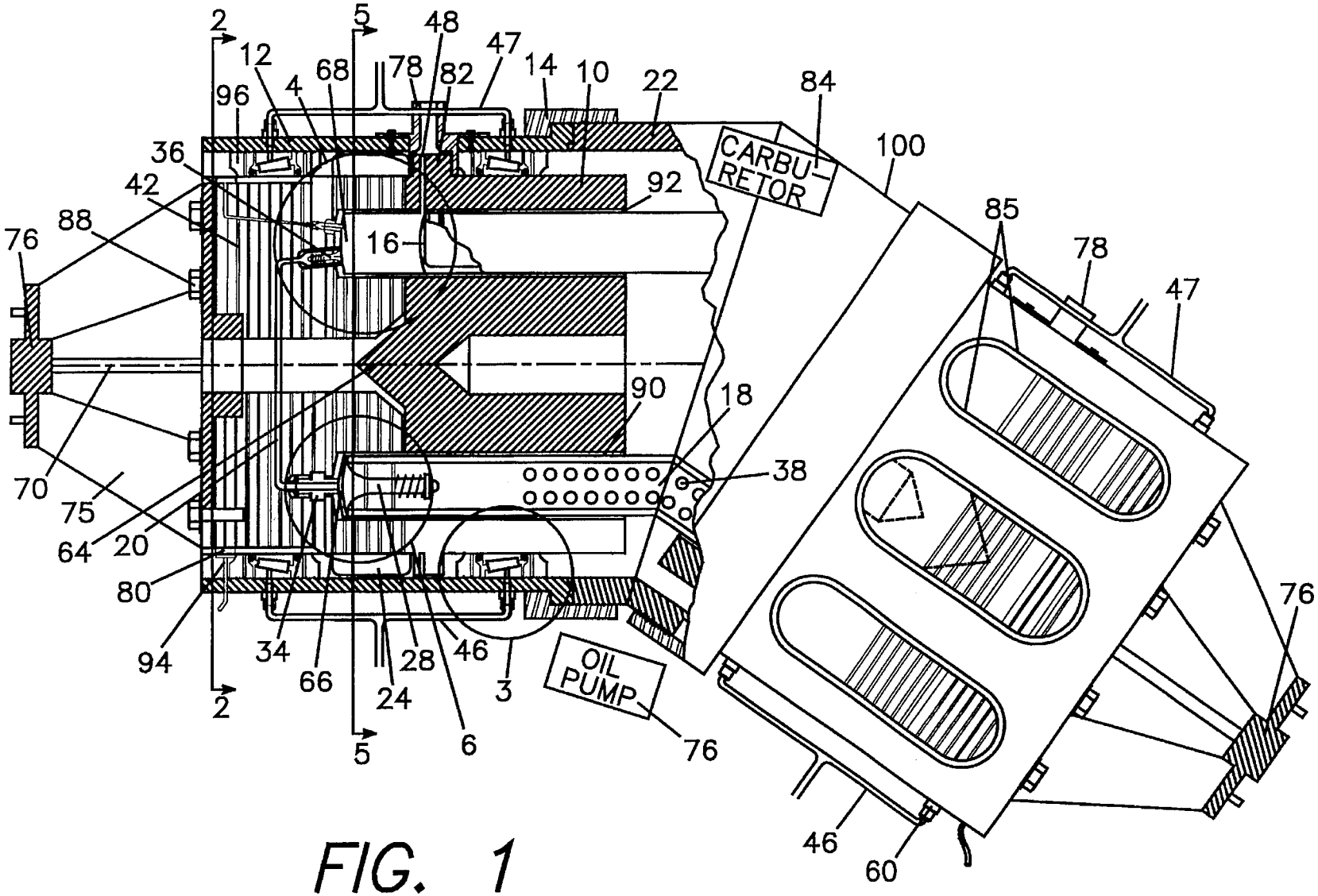
FIG. 1 shows a partial side elevation view, partly in section, of an angled piston engine of one embodiment of the present invention.

FIG. 1, shows an overall drawing of the preferred embodiment of the invention. Referring to FIG. 1, a rotary vee engine 100 has a supply piston induction system which embodies the present invention. The engine 100 contains cylinder blocks, housings, and other components that are positioned in the left and right side of the engine and are a mirror image of each other. Accordingly, these are given the same reference number.

The engine 100 generally includes a pair of cylinder block rotor assemblies 10, rotatably mounted in an engine housing assembly 12. Each cylinder block 10 has an equal number of cylinders 66 and 68, mounted therein, in an annular parallel relationship about a respective rotor center line axis 70. Each aligned pair of cylinders 66 and 68 has vee shaped piston assemblies 16 and 18, slidably and rotatably located therein. For each power piston 16 located within a cylinder 68, there is a corresponding supply piston 18 located in a cylinder 66. The power and supply pistons operate as pairs in 180 degree rotational relation to each other.

The supply pistons 18 are hollow and cooperate with the cylinders 66, as influenced by the relative motion between the pistons 18 and cylinders 66, to induct fuel/air charges through the hollow supply pistons 18. Through an interconnect 20, the supply pistons 18 deliver the fuel/air charges to the cylinder 68 that is located at a 180 degree rotational relation to the cylinder 66 and piston 18. The fuel air mixture is ignited in cylinder 68, and the resulting high pressure within the cylinder 68 causes the piston 18 to be pushed down. This causes the cylinder block 10 to rotate as the piston 18 moves away from the top dead center position to the bottom dead center. As the piston 18 reaches bottom dead center, an exhaust port 48 is uncovered allowing expulsion of the burned fuel air mix. When the exhaust port 48 is uncovered the pressure within the cylinder 68 drops below the pressure in the supply cylinder 66. This allows a fresh fuel air charge to be pushed through an interconnect fitting 34 of the supply cylinder 66, and pushed through interconnect 20, where the moving fuel air charge opens a power piston valve 36 to enter cylinder 68.

Through continued rotation of the cylinder block 10, the power piston 16 starts its travel upward toward top dead center to compress and fire the just delivered fuel air charge. At the same time, the supply piston 18 starts its travel downward toward the bottom dead center position. As the power piston 16 travels upward, the power piston valve 36 is closed by the increased air pressure being exerted by the upward travel of the power piston 16. A supply piston valve 28 is opened by the vacuum created by the downward travel of the supply piston 18. This vacuum is then filled with fresh fuel air charge drawn in at the apex of the supply piston 18 from the center section, through holes 38 in the supply piston 18.

Because of the location of the intake valve at the top of the power cylinder 68 and the exhaust port at the bottom of the power cylinder 68, when the exhaust port 48 is uncovered by the power piston 16, and the intake valve 36 opens, the incoming combustible mixture scavenges the exhaust gases almost perfectly.

The cylinder blocks 10 are comprised of a cast material such as aluminum. Shrink fit cylinder sleeves 90 and 92, made of a hardened steel for the high temperature and wear conditions, are fitted within the cylinders of the cylinder block 10. The supply piston 18, and the power piston 16 are each provided with rings 86 (shown in FIGS. 6 and 4 respectively), located at each end of the pistons, to provide the seal required between the pistons and the cylinder walls.

A center section 22 of the rotary vee 100 is sealed to provide the manifold for the fresh fuel air mix delivered by a carburetor 84, or other admixture device. The center section 22 holds the mixture until the mixture is drawn in by the supply piston 18. The rotating pistons 16 and 18 provide complete mixing of the fuel air charge in the sealed center section.

An exhaust collector 78 is mounted to the outer housing 12, and it forms a sealing relation to the cylinder block exhaust ring 82. The exhaust collector 78 collects the byproducts of combustion that are expelled through the exhaust ports 48. The exhaust port 48 for each cylinder, is uncovered by the power piston from approximately 175 degrees to 185 degrees rotation.

The cylinder block outer housings 12, are attached to a generally cast and then machined center section 22, by way of machined retainer rings 14, threaded to the center section 22. The center section 22 holds the outer housings 12 in the proper angled alignment, and provides a mounting location for a carburetor 84, or other admixture device.

A a power takeoff 76 is attached by a plurality of bolts 88 to the top of each end of the cylinder blocks 10. The power takeoffs are mounted on both cylinder blocks so that one side of the engine can be used to provide power to turn a transmission, propeller, or other means, while the opposite end of the engine can be utilized to turn an electrical generator, pump, or other accessories.

Figure 2:
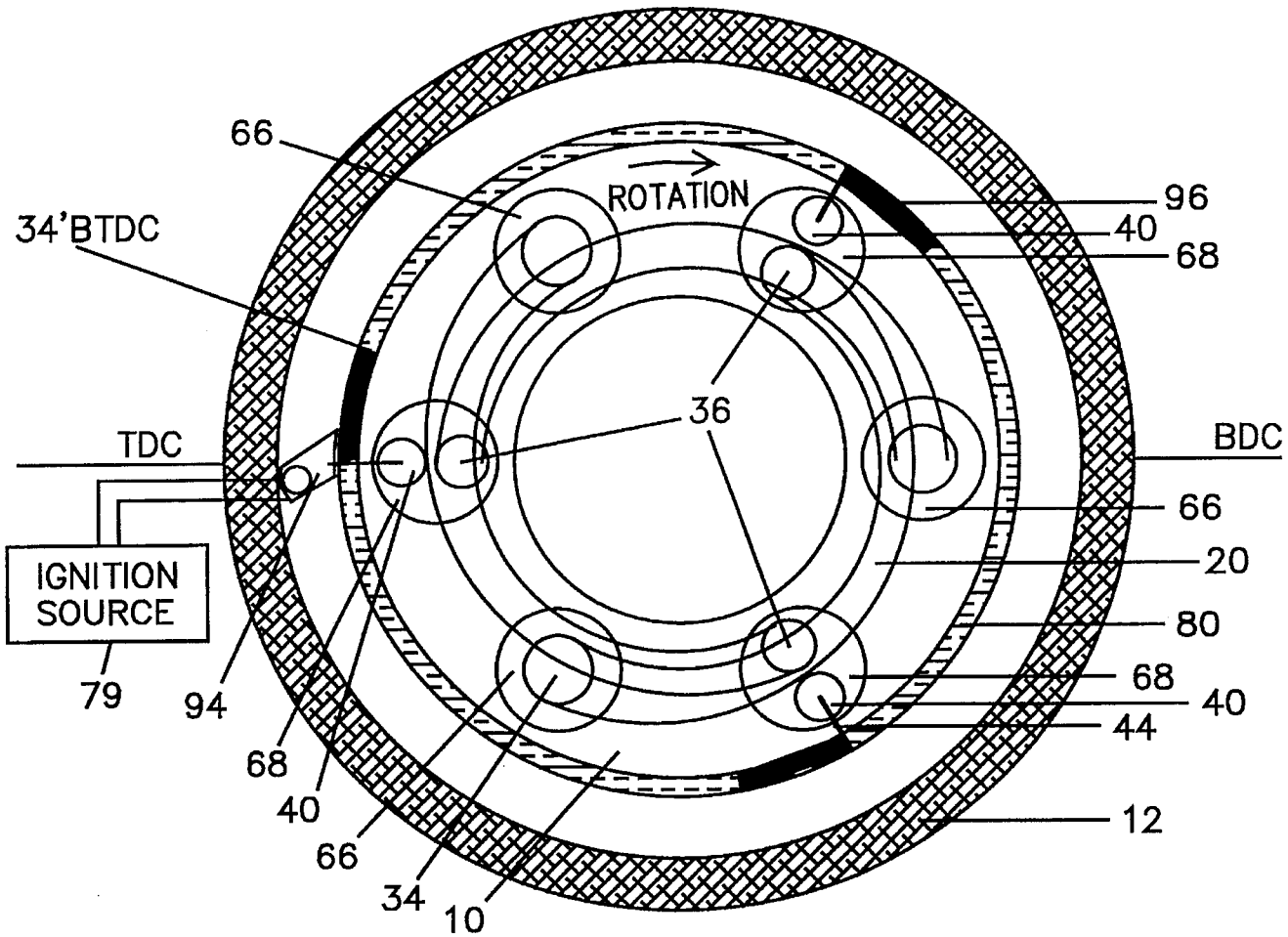
FIG. 2 shows a cross section end view of the engine taken along the line 2—2 in FIG. 1.

FIG. 2 shows a cross section view taken along line 2—2 of FIG. 1. The spark plugs 40, installed only in the power piston cylinders 68, are connected to a slip ring 80, by a conductor 44. The slip ring 80 is made up of segments that are insulated from each other, wherein one segment is connected to each spark plug. The rotational position of the cylinder blocks is sent to an ignition source 79 via conventional means. A brush 94, mounted in the outer housing 12 and connected to the ignition source 79, rides full time on the segmented slip-ring 80 to deliver a high voltage electrical impulse to the conductor 44, and through the conductor 44 to the spark plug 40. An electrical contact 96, within the slip-ring 80 and connected to the conductor 44, comes into contact with the brush 94 between 34 degrees before top dead center to 0 degrees before top dead center. The ignition source 79 can be a magneto or other means (not shown) driven by the engine.

Figure 3:
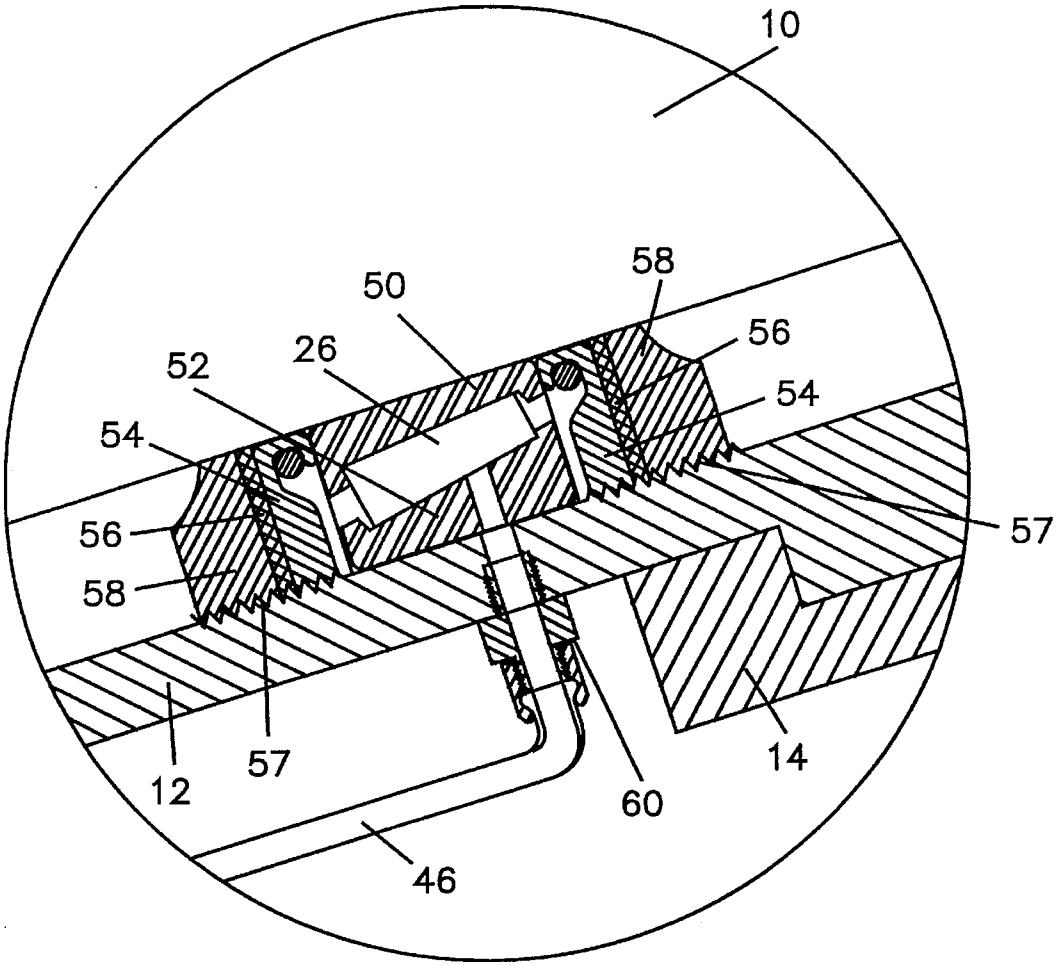
FIG. 3 shows an expanded view of the bearing assembly taken from the circle 3 in FIG. 1.

FIGS. 1 and 3 illustrates a dry sump oiling system that is incorporated in the engine 100, including an oil pump 76. FIG. 3 shows an exploded view of the bearing assembly, taken about circle 3 of FIG. 1. Referring to FIGS. 1 and 3, the bearing assemblies 26 are provided with oil under pressure by the oil pump 76, oil delivery lines 46, and fittings 60. The oil is returned to the oil pump with fittings 60 and return lines 47. Seals 54 keep oil, which is under pressure, confined to the bearings 26.

The engine 100 includes a housing 12, generally of a cast material, wherein the cylinder block assemblies 10, are mounted to allow rotation. Support of the cylinder blocks 10 is provided within the housing 12 by tapered roller bearings 26, mounted at both ends of the cylinder blocks 10. A race assembly 50, made of a hardened steel material, is shrink fitted onto the cylinder blocks 10. A corresponding race assembly 52 is part of the outer housing 12, and is installed in a close tolerance fit with the housing 12. A retainer ring 58, installed on fore and aft sides of the bearing assembly 26, allows for fine adjustment between the cylinder block 10 and the outer housing 12. Included as part of the bearing assembly is a seal 54, that keeps the lubricating oil confined within the bearing. A dust seal 56, installed between the retainer 58 and the seal 54, keeps the bearings clean.

While the cylinder block assemblies 10 are mounted within the outer housing 12, with a lubricated bearing assembly 26, the fuel may constitute a mixture of a combustible fuel and an engine lubricant to provide lubrication between the pistons and their respective cylinder walls.

Figure 4:
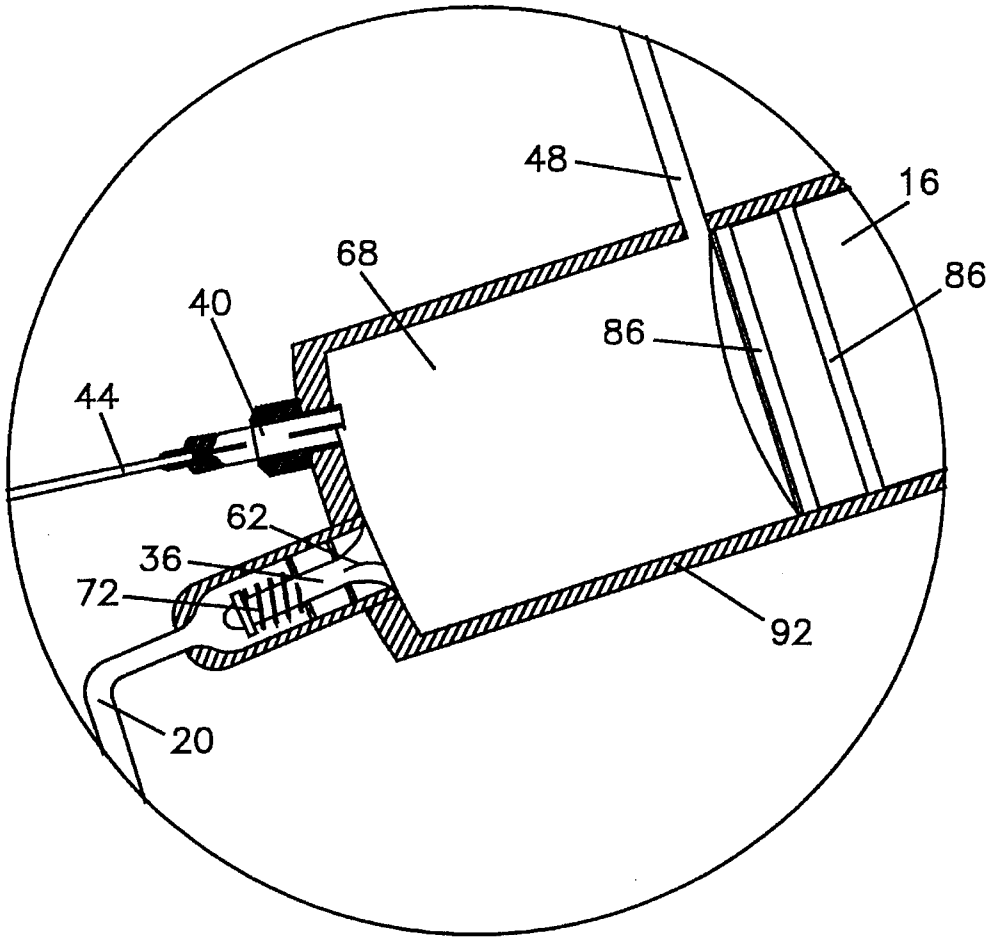
FIG. 4 shows an expanded view of the power piston cylinder top end taken from the circle 4 in FIG. 1.

FIG. 4 shows an expanded view of the power cylinder 68, and illustrates the exhaust port 48 being uncovered by the piston 16 as it travels to bottom dead center. Uncovering the exhaust port causes a drop of the pressure in the power cylinder 68 below the pressure in supply cylinder 66 (FIG. 1), which allows a fresh fuel air charge to be pushed from the supply cylinder 66 (FIG. 1), through interconnect firing 34 (FIG. 1), through interconnect 20 and to the piston valve 36. The moving fuel air charge opens the power piston valve 36, which is normally held closed by a spring 72. As the fresh fuel air charge pushes open the power piston valve 36, and rushes by the valve, flutes 62, that are an integral part of the power piston inlet valve 36, impart a rotation to the fuel air charge. This rotation keeps the fuel air mix stratified and helps to push exhaust gases out the exhaust port 48.

Figure 5:
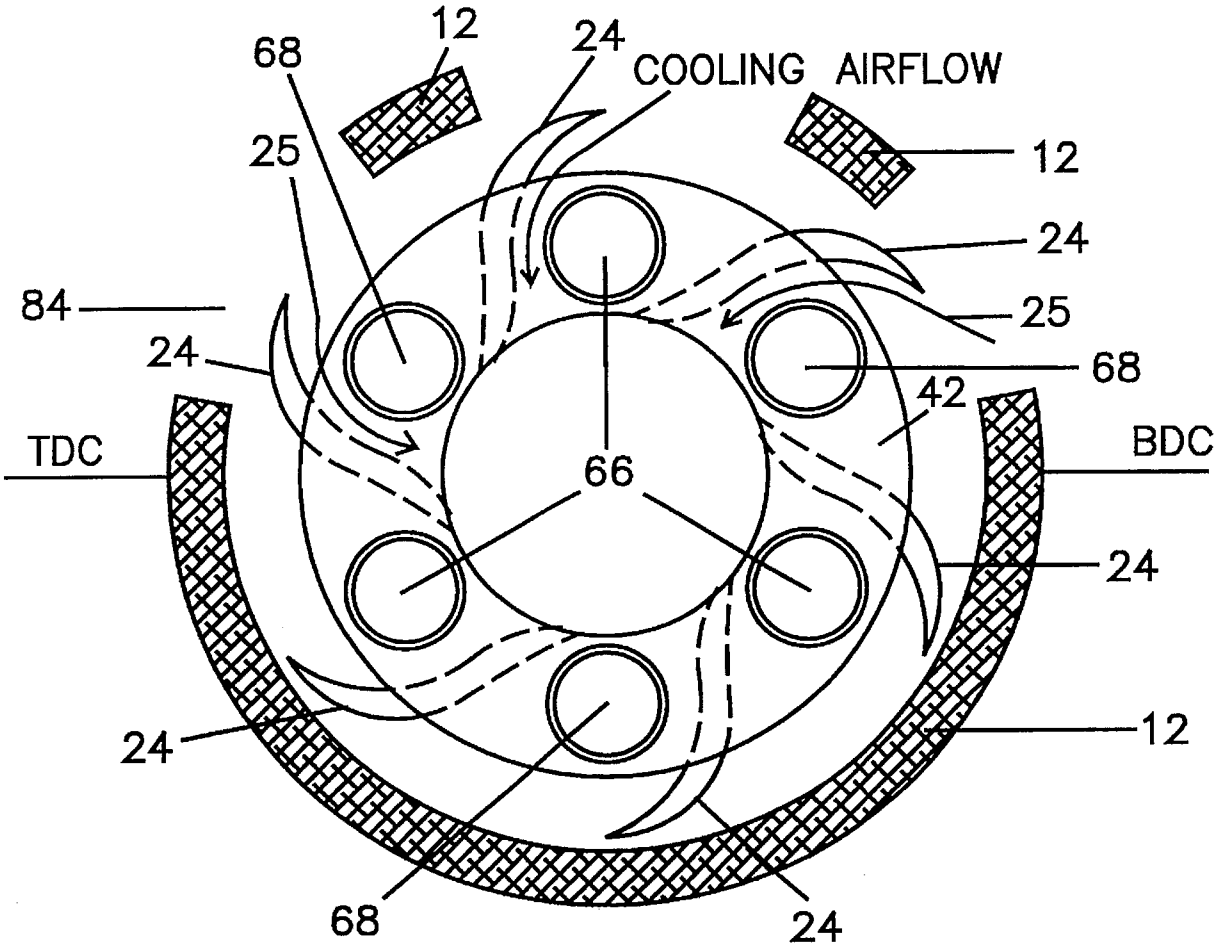
FIG. 5 shows a cross section end view of the engine taken along line 5—5 in FIG. 1.

FIG. 5 shows a cross section view taken along line 5—5 of FIG. 1. Referring to FIG. 5, each cylinder block is cast with a plurality of spaced rings 42 (also shown in FIG. 1), extending in a series about the cylinder block rotation axis adjacent the ends of the housing 12. The cylinder blocks have axially extending fin portions 24 (also shown in FIG. 1), passing through the rings 42. The fins 24 are cast as an integral part of the cylinder blocks. The cylinder block housings are cast with openings 85 (shown in FIG. 1), positioned to correspond to the piston travel of from top dead center to bottom dead center. As the cylinder blocks rotate to provide linear motion to the pistons, cooling air, as shown by arrows 25, is drawn in through the cutouts 85 by the cooling fins 24. The cooling air, after being drawn past the cylinders to remove heat created in the combustion process, travels to the center of the cylinder block where the conical shape 64 (FIG. 1), of the cylinder blocks 10, urges the now heated air out toward the ends of the cylinder blocks 10. The heated air will then travel outward and vent through the leg portions 75 (FIG. 1) of the power take offs 76.

Figure 6:
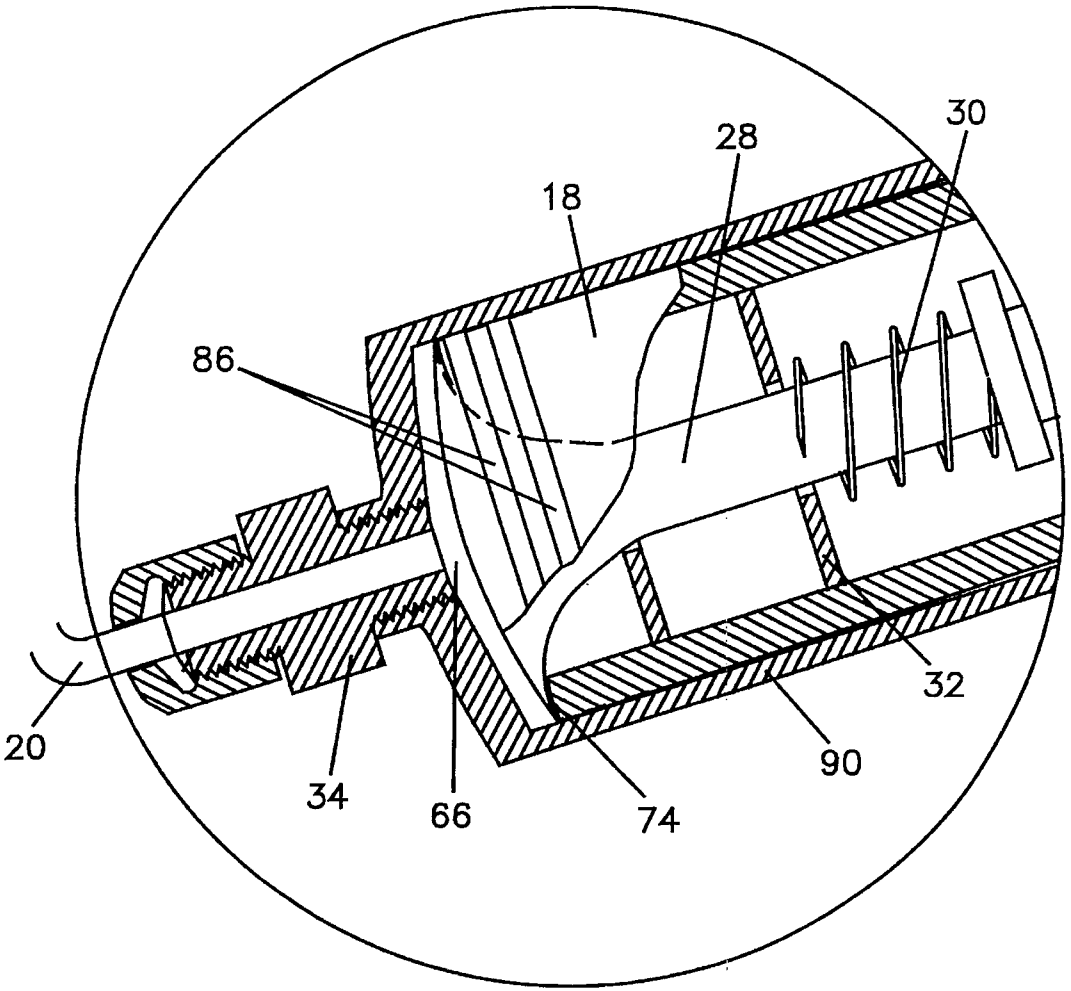
FIG. 6 shows an expanded view of the supply piston cylinder top end taken from the circle 6 in FIG. 1.

FIG. 6 shows an expanded view of the supply cylinder 66, taken about circle 6 in FIG. 1. Referring to FIG. 6, as the supply piston 18 starts its travel downward toward the bottom dead center position, the supply piston valve 28, which is held closed by a lightly biased spring 30, is drawn off its seat 74 by the vacuum created by the downward travel of the supply piston 18. This vacuum is then filled with a fresh fuel air charge drawn in at the apex of the supply piston 18 from the center section, through holes 38 (FIG. 1) in the supply piston 18. Rings 86 seal the supply piston 18 to the cylinder wall 90.

The foregoing description of the preferred embodiment of the invention has been presented for the purposes of illustration and description. It in not intended to be exhaustive or to limit the invention to the precise form disclosed. Many modifications and variations are possible in light of the above teaching.

Accordingly a discussion of some obvious alternatives to the foregoing description are included, they are:

In the power takeoffs shown on the outer ends of the cylinder blocks 10, any power take-off configuration can be used so long as the required air passage for cooling air is included within the power take-off configuration.

A mush-room type poppet valve is shown on the supply cylinders 66, however the principle of the supply piston induction of the present invention can be accomplished equally well with other valve principles used in engine manufacture, particularly those of the reed valve type currently in use in two stroke engines, While the cylinder blocks 10 are supported within the housings 12 with a tapered roller bearing, an equally well supported cylinder block can be accomplished through the use of roller ball type bearings.

The present invention will work equally well with utilization of glow plugs in place of the current spark plugs for burning of a diesel fuel, and this would also allow for elimination of an engine lubricant mixed with the fuel.

The present invention will allow for any number of power piston and supply piston pairs within engine size limitations. This invention is applicable, of course, where only one-half or one cylinder block of the vee engine is employed, wherein a "wobble plate" is employed with only one cylinder block, head and pistons.

While FIG. 1 shows supply pistons and power pistons of equal size, an advantage of this induction system allows for increasing the size of the supply pistons in relation to the power pistons to achieve a super charging effect, particularly beneficial in aviation use for altitude compensation.

I claim:

1. In a rotary engine of a type including two cylinder blocks that are cylindrical in shape and mounted within a housing, wherein each cylinder block is supported within the housing to allow rotation, and wherein each cylinder block contains a plurality of parallel cylinders each containing a portion of a double ended piston, and further wherein the cylinder blocks are angled in relation to each other of between 90 and 180 degrees to form a "V", and as the pistons move from an inside portion of the "V" to an outside portion of the "V" the free volume of each cylinder changes allowing for compression and expansion of a fuel air admixture, and still further wherein each cylinder block is connected to an output system for providing the engine with rotational power output, a fuel supply system comprising:

a supply cylinder corresponding to each power cylinder contained within said rotary engine;

means for providing a fuel air admixture to each said supply cylinder, as a supply piston within said supply cylinder moves through an intake stroke;

means connecting each said supply cylinder and said corresponding power cylinder, and rotating therewith, for conducting said fuel air admixture from each said supply cylinder to said corresponding power cylinder.

2. A rotary engine in accordance with claim 1 wherein each supply piston comprises a hollow central portion connected to draw said fuel air charge from an apex of the rotary engine through said hollow central portion into said supply cylinder.

3. A rotary engine in accordance with claim 2 further comprising a sealable connection between said hollow central portion and an outer portion of said supply piston, wherein said sealable connection controls the flow of a fuel air mix drawn from the apex of the engine through said hollow central portion into said supply cylinder.

4. A rotary engine in accordance with claim 1 comprising a valve between said connecting means and a top end of said power cylinder, wherein said valve controls the flow of said fuel air mix into said power cylinder.

5. A rotary engine in accordance with claim 4 wherein said valve further comprises at least one flute, wherein said at least one flute imparts a rotation to the incoming fuel air charge.

6. A rotary engine in accordance with claim 4 wherein said valve further comprises a lightly biased spring, wherein said spring is biased to close said valve.

7. A rotary engine in accordance with claim 4 further comprising an exhaust means located at an end of said power cylinder opposite an end of said power cylinder containing said valve.

* * * * *